US009837796B2

(12) United States Patent
Inoue

(10) Patent No.: US 9,837,796 B2
(45) Date of Patent: Dec. 5, 2017

(54) SPARK PLUG

(71) Applicant: NGK Spark Plug Co., LTD., Nagoya (JP)

(72) Inventor: Masahiro Inoue, Gifu (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 259 days.

(21) Appl. No.: 14/755,225

(22) Filed: Jun. 30, 2015

(65) Prior Publication Data

US 2015/0380906 A1 Dec. 31, 2015

(30) Foreign Application Priority Data

Jun. 30, 2014 (JP) ..... 2014-134328

(51) Int. Cl.
*H01T 13/32* (2006.01)

(52) U.S. Cl.
CPC ..... *H01T 13/32* (2013.01)

(58) Field of Classification Search
CPC ..... H01T 13/32
See application file for complete search history.

(56) References Cited

U.S. PATENT DOCUMENTS 5,347,193 A * 9/1994 Oshima ..... H01T 13/39 313/141
5,440,198 A * 8/1995 Oshima ..... H01T 21/02 313/141
6,078,129 A * 6/2000 Gotou ..... H01T 21/02 313/141
2002/0105254 A1 8/2002 Hori et al.
2002/0121849 A1 9/2002 Kanao et al.
2008/0174221 A1* 7/2008 Tinwell ..... H01T 13/32 313/141
2009/0140625 A1 6/2009 Kato
2014/0203701 A1 7/2014 Kretschmar et al.

FOREIGN PATENT DOCUMENTS

DE 10205075 A 9/2002
JP 2014-519169 A 8/2014
WO WO-2012/167972 A 12/2012

OTHER PUBLICATIONS

Extended European Search Report mailed Oct. 30, 2015 for the corresponding European Application No. 15173677.4.

* cited by examiner

*Primary Examiner* — Donald Raleigh
*Assistant Examiner* — Jacob R Stern
(74) *Attorney, Agent, or Firm* — Leason Ellis LLP

(57) ABSTRACT

A spark plug capable of suppressing the occurrence and growth of a crack and oxide scale between an electrode tip and a melt portion, satisfies the relationships of C1≥D1 and C2≥D2, where C1 is a distance between a reference line RL and a point Pa5, D1 is a distance between the reference line RL and a point Pa1, C2 is a distance between the reference line RL and a point Pa6 and D2 is a distance between the reference line RL and a point Pa2.

4 Claims, 7 Drawing Sheets

| SAMPLE | TIP DIAMETER W | EACH DIMENSION | | | | DIMENSION RATIO | | PEELING RESISTANCE |
|---|---|---|---|---|---|---|---|---|
| | | C1 | C2 | D1 | D2 | C1/D1 | C2/D2 | |
| 1 | 0.8 | 0.36 | 0.37 | 0.47 | 0.55 | 0.8 | 0.7 | × |
| 2 | 0.8 | 0.46 | 0.38 | 0.45 | 0.38 | 1.0 | 1.0 | ○ |
| 3 | 0.8 | 0.55 | 0.47 | 0.37 | 0.40 | 1.5 | 1.2 | ◎ |
| 4 | 0.8 | 0.44 | 0.53 | 0.32 | 0.32 | 1.4 | 1.7 | ◎ |
| 5 | 0.8 | 0.51 | 0.55 | 0.30 | 0.29 | 1.7 | 1.9 | ◎ |
| 6 | 1.0 | 0.39 | 0.45 | 0.47 | 0.41 | 0.8 | 1.1 | × |
| 7 | 1.0 | 0.44 | 0.48 | 0.44 | 0.39 | 1.0 | 1.2 | ○ |
| 8 | 1.0 | 0.47 | 0.53 | 0.39 | 0.35 | 1.2 | 1.5 | ◎ |
| 9 | 1.0 | 0.52 | 0.45 | 0.31 | 0.33 | 1.7 | 1.4 | ◎ |
| 10 | 1.0 | 0.55 | 0.51 | 0.30 | 0.29 | 1.8 | 1.8 | ◎ |
| 11 | 1.5 | 0.46 | 0.42 | 0.49 | 0.40 | 0.9 | 1.1 | × |
| 12 | 1.5 | 0.48 | 0.40 | 0.42 | 0.39 | 1.1 | 1.0 | ○ |
| 13 | 1.5 | 0.56 | 0.51 | 0.38 | 0.42 | 1.5 | 1.2 | ◎ |
| 14 | 1.5 | 0.55 | 0.46 | 0.33 | 0.34 | 1.7 | 1.4 | ◎ |
| 15 | 1.5 | 0.54 | 0.57 | 0.32 | 0.33 | 1.7 | 1.7 | ◎ |

FIG. 7

SPARK PLUG

This application claims the benefit of Japanese Patent Applications No. 2014-134328, filed Jun. 30, 2014, which is incorporated by reference in its entities herein.

FIELD OF THE INVENTION

The present invention relates to an electrode of a spark plug.

BACKGROUND OF THE INVENTION

Conventionally, there is a technique to provide an electrode tip made of a noble metal at a ground electrode of a spark plug (see International Publication No. WO 2012/167972). In this conventional technique, the electrode tip is welded to an electrode base material forming the ground electrode. That is, the electrode tip is joined to the electrode base material via a melt portion which is formed by a portion of the electrode tip and a portion of the electrode base material being melted in welding.

Problems to be Solved by the Invention

In recent years, due to trend of high compression and high supercharging of an internal combustion engine, the ground electrode of a spark plug is exposed to a higher temperature than before. Thus, the difference between the temperature of the ground electrode during combustion of fuel and the temperature of the ground electrode between combustion and combustion is made greater than before. As a result, due to the difference between the thermal expansion coefficient of the electrode tip and the thermal expansion coefficient of the melt portion, a crack is likely to occur between the electrode tip and the melt portion. Due to the crack, oxide scale is likely to grow. Thus, it is difficult to ensure a high service life of the spark plug.

Means for Solving the Problems

The present invention has been made to solve the above-described problem, and can be embodied in the following modes.

SUMMARY OF THE INVENTION (1) According to one mode of the present invention, a spark plug is provided. The spark plug includes a ground electrode including:

a tip having a columnar portion at one end side and containing a noble metal as a principal component; and an electrode base material, at least a portion of another end side of the tip being joined to the electrode base material via a melt portion formed by the tip and the electrode base material being melted together. In the spark plug, in a cross section passing through a central axis of the columnar portion, both a first point and a second point are located at a position whose distance to the central axis in a direction perpendicular to the central axis is shorter than ⅔ of a length from the central axis to an outer surface of the columnar portion, where the first point is located on the melt portion at one side with respect to the central axis and is farthest from a surface of the tip at the one end side in a direction of the central axis; and the second point is located on the melt portion at another side with respect to the central axis and is farthest from the surface of the tip at the one end side in the direction of the central axis. In the cross section, when a line connecting a third point and a fourth point is defined as a reference line, the spark plug satisfies a relationship of: C1≥D1 and C2≥D2, where, the third point is located on the melt portion at the one side with respect to the central axis and is farthest from the central axis and the fourth point is located on the melt portion at the other side with respect to the central axis and is farthest from the central axis.

A distance between the reference line and a fifth point is defined as C1, where the fifth point is located on the melt portion at the one side with respect to the central axis and is closest to the surface of the tip at the one end side in the direction of the central axis. A distance between the reference line and a sixth point is defined as C2, where the sixth point is located on the melt portion at the other side with respect to the central axis and is closest to the surface of the tip at the one end side in the direction of the central axis. A distance between the first point and the reference line is defined as D1. A distance between the second point and the reference line is defined as D2.

In such a mode, the amount of a component of the tip in the melt portion can be increased as compared to a mode where C1<D1 or C2<D2 is satisfied. As a result, the difference in thermal expansion at an interface between the melt portion and the tip can be decreased, and thus occurrence of a crack and growth of oxide scale at the interface between the melt portion and the tip can be suppressed.

The phrase "both a first point and a second point are located at a position whose distance to the central axis in the direction perpendicular to the central axis is shorter than ⅔ of the length from the central axis to an outer surface of the columnar portion" means that (i) the length (distance) from the central axis to the first point is shorter than ⅔ of the length (distance) from the central axis to an outer surface at the same side as the first point, of two outer surfaces of an end portion; and (ii) the length (distance) from the central axis to the second point is shorter than ⅔ of the length (distance) from the central axis to the outer surface at the same side as the second point, of the two outer surfaces of the end portion.

(2) The spark plug of the above mode may satisfy a relationship of:

$$C1/D1 \geq 1.2 \text{ and } C2/D2 \geq 1.2.$$

In such a mode, the amount of the component of the tip in the melt portion can be increased as compared to a mode where C1/D1<1.2 or C2/D2<1.2 is satisfied. As a result, the difference in thermal expansion at the interface between the melt portion and the tip can be decreased, and thus occurrence of a crack and growth of oxide scale at the interface between the melt portion and the tip can be suppressed.

(3) In the spark plug of the above mode, the other end side of the tip may be not in direct contact with the electrode base material and may be joined to the electrode base material via the melt portion.

In such a mode, the tip and the base material having different thermal expansion coefficients are disposed with the melt portion, which has an intermediate thermal expansion coefficient between these thermal expansion coefficients, being interposed therebetween. Thus, occurrence of a crack at the joined portion between the tip and the ground electrode can be suppressed.

The present invention can be embodied in various forms other than the spark plug. For example, the present invention can be embodied in forms such as a ground electrode, a method for welding a ground electrode, a method for manufacturing a ground electrode, and a method for manufacturing a spark plug.

BRIEF DESCRIPTION OF THE DRAWINGS

These and other features and advantages of the present invention will become more readily appreciated when considered in connection with the following detailed description and appended drawings, wherein like designations denote like elements in the various views, and wherein:

FIG. 7 is a table showing results of a peeling resistance test.

DETAILED DESCRIPTION OF THE INVENTION

A. First Embodiment

A1. Overall Structure of Spark Plug

Figure 1:
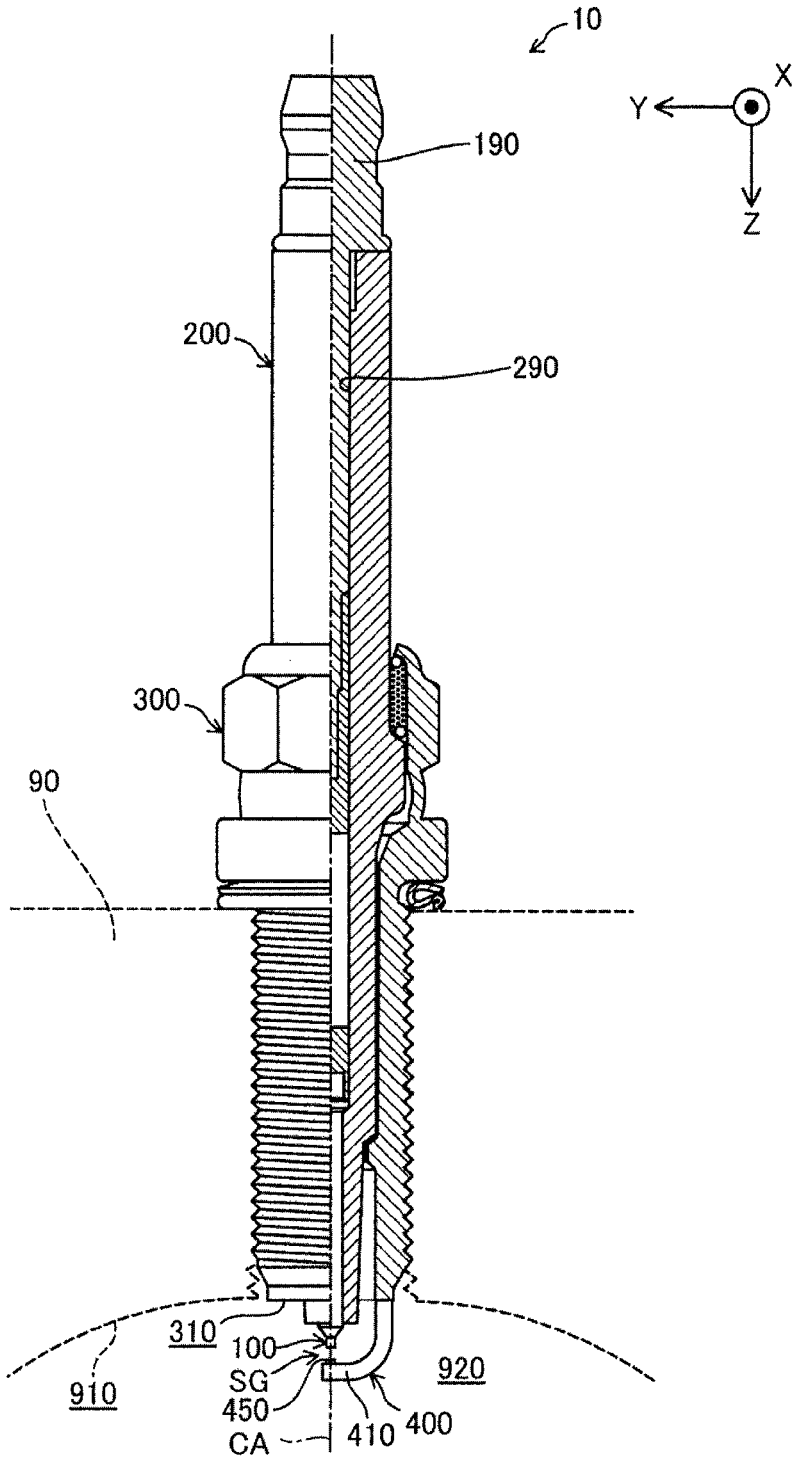
FIG. 1 is an explanatory view showing a partial cross section of a spark plug 10.

FIG. 1 is an explanatory view showing a partial cross section of a spark plug 10. In FIG. 1, with an axis CA, which is the axis of the spark plug 10, as a boundary, the external shape of the spark plug 10 is shown at the left side of the axis CA in the sheet of FIG. 1, and the cross-sectional shape of the spark plug 10 is shown at the right side of the axis CA in the sheet of FIG. 1. In the description of the present embodiment, in the spark plug 10, the lower side in the sheet of FIG. 1 is referred to as "front side", and the upper side in the sheet of FIG. 1 is referred to as "rear side".

The spark plug 10 includes a center electrode 100, an insulator 200, a metallic shell 300, and a ground electrode 400. In the present embodiment, the axis CA of the spark plug 10 is also the axis of each of the center electrode 100, the insulator 200, and the metallic shell 300.

The spark plug 10 has, at the front side thereof, a gap SG formed between the center electrode 100 and the ground electrode 400. The gap SG of the spark plug 10 is referred to also as "spark gap". The spark plug 10 is configured to be mountable to an internal combustion engine 90 in a state where the front side thereof at which the gap SG is formed projects from an inner wall 910 of a combustion chamber 920. When a high voltage (e.g., 10 thousand to 30 thousand volts) is applied to the center electrode 100 in a state where the spark plug 10 is mounted on the internal combustion engine 90, spark discharge occurs in the gap SG. The spark discharge which has occurred in the gap SG ignites an air-fuel mixture in the combustion chamber 920.

FIG. 1 shows X, Y, and Z axes which are orthogonal to each other. The X, Y, and Z axes in FIG. 1 correspond to X, Y, and Z axes in other drawings described later.

Of the X, Y, and Z axes in FIG. 1, the X axis is an axis orthogonal to the Y axis and the Z axis. In the X axis direction along the X axis, a +X axis direction is a direction from the depth side of the sheet of FIG. 1 toward the near side thereof, and a −X axis direction is a direction opposite to the +X axis direction.

Of the X, Y, and Z axes in FIG. 1, the Y axis is an axis orthogonal to the X axis and the Z axis. In the Y axis direction along the Y axis, a +Y axis direction is a direction from the right side of the sheet of FIG. 1 toward the left side thereof, and a −Y axis direction is a direction opposite to the +Y axis direction.

Of the X, Y, and Z axes in FIG. 1, the Z axis is an axis along the axis CA. In the Z axis direction along the Z axis (an axial direction), a +Z axis direction is a direction from the rear side of the spark plug 10 toward the front side thereof, and a −Z axis direction is a direction opposite to the +Z axis direction.

The center electrode 100 of the spark plug 10 is an electrode having electrical conductivity. The center electrode 100 has a bar shape extending with the axis CA as a center. In the present embodiment, the center electrode 100 is formed from a nickel alloy (e.g., INCONEL 601 ("INCONEL" is a registered trademark)) containing nickel (Ni) as a principal component. In the description of the present specification, the term "principal component" means a component contained in a largest amount when each component contained in the element is compared in mass %. The front side of the center electrode 100 projects from the front side of the insulator 200. The center electrode 100 is electrically connected to a metal terminal 190.

The insulator 200 of the spark plug 10 is an insulator having an electrical insulation property. The insulator 200 has a tubular shape extending with the axis CA as a center. In the present embodiment, the insulator 200 is produced by baking an insulating ceramic material (e.g., alumina). The insulator 200 has an axial bore 290 which is a through hole extending with the axis CA as a center. The center electrode 100 is held in the axial bore 290 of the insulator 200 and on the axis CA in a state where the center electrode 100 projects from the front side of the insulator 200.

The metallic shell 300 of the spark plug 10 is a metallic body having electrical conductivity. The metallic shell 300 has a tubular shape extending with the axis CA as a center. In the present embodiment, the metallic shell 300 is a member in which low-carbon steel formed into a tubular shape is subjected to nickel plating. In another embodiment, the metallic shell 300 may be a member subjected to zin plating, or may be a member not subjected to plating (unplated). The metallic shell 300 is fixed to the outer surface of the insulator 200 by means of crimping in a state of being electrically insulated from the center electrode 100. The metallic shell 300 has an end surface 310 formed at the front side thereof. The insulator 200 projects together with the center electrode 100 from the center of the end surface 310 in the +Z axis direction. The ground electrode 400 is joined to the end surface 310.

The ground electrode 400 of the spark plug 10 is an electrode having electrical conductivity. The ground electrode 400 includes an electrode base material 410 and an electrode tip 450. The electrode base material 410 has a shape in which the electrode base material 410 extends from the end surface 310 of the metallic shell 300 in the +Z axis direction and then bends toward the axis CA. The rear side of the electrode base material 410 is joined to the metallic shell 300. The electrode tip 450 is joined to the front side of the electrode base material 410. The electrode tip 450 forms the gap SG between the center electrode 100 and the electrode tip 450.

In the present embodiment, the material of the electrode base material 410 is a nickel alloy containing nickel (Ni) as a principal component, similarly to the center electrode 100. In the present embodiment, the material of the electrode tip 450 is an alloy containing platinum (Pt) as a principal component and 10 mass % of nickel (Ni). In another embodiment, the material of the electrode tip 450 may be any material which is more excellent in durability than the electrode base material 410, may be a pure noble metal (e.g., platinum (Pt), iridium (Ir), ruthenium (Ru), rhodium (Rh), etc.), or may be another alloy containing one of these noble metals as a principal component.

A2. Structure Around Electrode Tip of Ground Electrode

Figure 2:
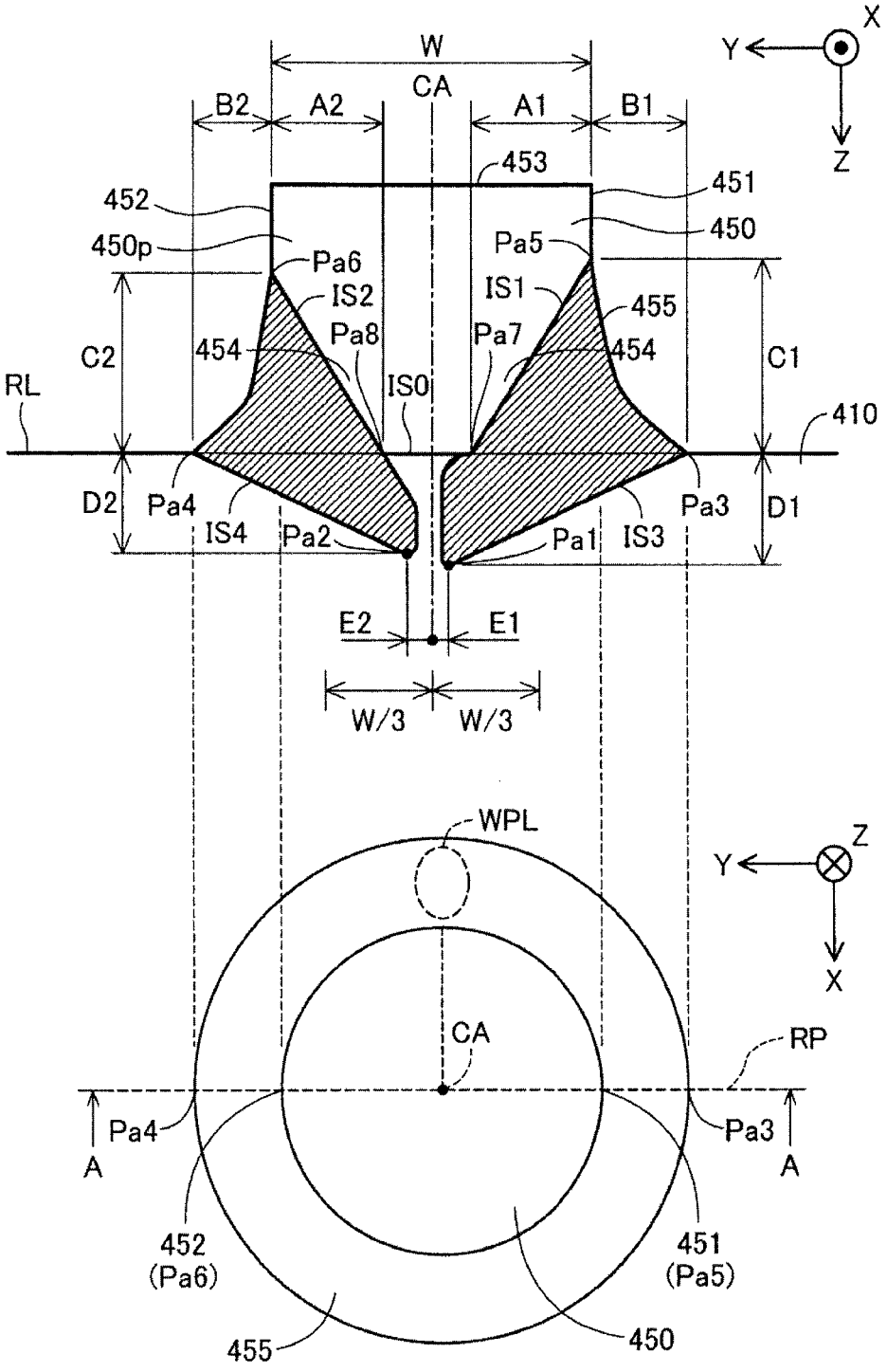
FIG. 2 is a cross-sectional view and plan view showing a structure around an electrode tip 450 provided at a ground electrode 400 of the spark plug 10.

FIG. 2 is a cross-sectional view and a plan view showing a structure around the electrode tip 450 provided at the ground electrode 400 of the spark plug 10. The electrode tip 450 has a substantially cylindrical shape. The electrode tip 450 is disposed at the ground electrode 400 such that the axis CA of the spark plug 10 coincides with the central axis of the cylinder of the electrode tip 450.

The following process is performed in providing the electrode tip 450 at the ground electrode 400. First, the electrode tip 450 is placed at a predetermined position on the electrode base material 410. Then, the electrode tip 450 and the electrode base material 410 are resistance-welded to each other. As a result, the electrode tip 450 and the electrode base material 410 are temporarily fixed to each other. Thereafter, a laser beam is applied to a site where the electrode tip 450 and the electrode base material 410 are in contact with each other, from around the electrode tip 450, so that the electrode tip 450 and the electrode base material 410 are laser-welded to each other. For the laser welding, any laser such as a gas laser, a solid-state laser, and a semiconductor laser can be used.

In laser welding, the laser beam is applied in a direction from the outer periphery of the electrode tip 450 toward the axis CA of the electrode tip 450 which is a direction from the electrode tip 450 side toward the electrode base material 410 side. The application of the laser beam is performed from around the electrode tip 450 toward the electrode tip 450 and the electrode base material 410 at 10 to 20 locations which are located at substantially equal angular positions with respect to the axis CA.

As a result, a portion of the electrode tip 450 and a portion of the electrode base material 410 are melted together to form a melt portion 455. When the melt portion 455 is cooled and solidified, an end portion 454 at a side opposite in the axial direction to an end surface 453 at an exposed side, of the electrode tip 450, and the electrode base material 410 are joined to each other via the melt portion 455. Of the electrode tip 450 that has not been melted, an end portion 450*p* at a side opposite to the electrode base material 410 has a cylindrical shape. Therefore, the end surface 453 is circular. The cross-sectional view at the upper part of FIG. 2 is a cross-sectional view on an A-A cross section RP passing through the axis CA and including a direction in which the ground electrode 400 extends toward the axis CA (see the lower part of FIG. 2). In the present embodiment, the cross section RP is a surface which does not include a portion WPL melted last by the applied laser beam, of the melt portion 455.

In the present specification, when a state after the melt portion 455 is formed is described, a portion that has not been melted, of the electrode tip 450 that is prepared initially together with the electrode base material 410, is referred to as "electrode tip 450". In addition, when a state after the melt portion 455 is formed is described, a portion that has not been melted, of the electrode base material 410 that is prepared initially together with the electrode tip 450, is referred to as "electrode base material 410".

As a result of laser welding, the formed melt portion 455 has a shape described below in a cross section passing through the axis CA. A reference character denoting each portion of the electrode tip 450 is defined as follows.

451: an outer surface of the cylindrical portion 450*p* of the electrode tip 450 at one side (the right side in FIG. 2) with respect to the axis CA.

452: an outer surface of the cylindrical portion 450*p* of the electrode tip 450 at the other side (the left side in FIG. 2) with respect to the axis CA.

453: an end surface of the electrode tip 450 at a side opposite in the axial direction to the side at which the electrode base material 410 is located.

A reference character denoting each portion of the melt portion 455 is defined as follows.

Pa1: a point farthest from the end surface 453 in the axial direction, on the melt portion 455 at the one side (the right side in FIG. 2) with respect to the axis CA.

Pa2: a point farthest from the end surface 453 in the axial direction, on the melt portion 455 at the other side (the left side in FIG. 2) with respect to the axis CA.

Pa3: a point farthest from the axis CA, on the melt portion 455 at the one side with respect to the axis CA.

Pa4: a point farthest from the axis CA, on the melt portion 455 at the other side with respect to the axis CA.

Pa5: a point closest to the end surface 453 in the axial direction, on the melt portion 455 at the one side with respect to the axis CA.

Pa6: a point closest to the end surface 453 in the axial direction, on the melt portion 455 at the other side with respect to the axis CA.

Pa7: an end point of an interface ISO between the electrode tip 450 and the electrode base material 410 at the one side with respect to the axis CA.

Pa8: an end point of the interface ISO between the electrode tip 450 and the electrode base material 410 at the other side with respect to the axis CA.

RL: a reference line which is a straight line passing through the point Pa3 and the point Pa4.

A reference character denoting a dimension of the electrode tip 450 is defined as follows.

W: a width of the electrode tip 450 at an end at a side opposite in the axial direction to the side at which the electrode base material 410 is located (in the present embodiment, the diameter of the cylinder of the cylindrical portion 450*p*).

A reference character denoting a dimension of each portion of the electrode tip 450 and the melt portion 455 at the one side with respect to the axis CA is defined as follows.

A1: a distance between the outer surface 451 of the cylindrical portion 450*p* of the electrode tip 450 and the point Pa7.

B1: a distance between the outer surface 451 of the cylindrical portion 450*p* of the electrode tip 450 and the point Pa3.

C1: a distance between the reference line RL and the point Pa5.

D1: a distance between the reference line RL and the point Pa1.

E1: a distance between the axis CA and the point Pa1.

In the present specification, a distance between a straight line and a point is defined as the length of a perpendicular extending from the point to the straight line.

A reference character denoting a dimension of each portion of the electrode tip 450 and the melt portion 455 at the other side with respect to the axis CA is defined as follows.

A2: a distance between the outer surface 452 of the cylindrical portion 450*p* of the electrode tip 450 and the point Pa8.

B2: a distance between the outer surface 452 of the cylindrical portion 450*p* of the electrode tip 450 and the point Pa4.

C2: a distance between the reference line RL and the point Pa6.

D2: a distance between the reference line RL and the point Pa2.

E2: a distance between the axis CA and the point Pa2.

In the present embodiment, the melt portion 455 has a shape which satisfies the following condition, in the cross section passing through the axis CA:

$$C1 \geq D1 \quad (1), \text{ and}$$

$$C2 \geq D2 \quad (2).$$

The satisfaction of the above formulas (1) and (2) means that as compared to a mode where the above formulas (1) and (2) are not satisfied, a more amount of the electrode tip 450 is melted to form the melt portion 455. That is, in such a mode, as compared to the mode where the above formulas (1) and (2) are not satisfied, the proportion of the material of the electrode tip 450 in the material of the melt portion 455 can be increased. As a result, the thermal expansion coefficient (linear expansion coefficient) of the melt portion 455 can be close to the thermal expansion coefficient of the electrode tip 450. Thus, a possibility can be reduced that when the spark plug 10 is mounted to an engine and the engine is operated so that a combustion cycle is executed, a crack occurs and grows at interfaces IS1 and IS2 between the melt portion 455 and the electrode tip 450 due to the difference in thermal expansion coefficient between the melt portion 455 and the electrode tip 450. In addition, as a result, a possibility can also be reduced that oxide scale grows at the crack portion.

Melting a more amount of the electrode tip 450 to increase the proportion of the material of the electrode tip 450 in the material of the melt portion 455 means that the proportion of the material of the electrode base material 410 in the material of the melt portion 455 is relatively decreased. As a result, the difference between the thermal expansion coefficient of the melt portion 455 and the thermal expansion coefficient of the electrode base material 410 increases. Thus, strain at interfaces IS3 and IS4 between the melt portion 455 and the electrode base material 410 also relatively increases.

However, the interfaces IS3 and IS4 between the melt portion 455 and the electrode base material 410 are located farther from the spark gap SG than the interfaces IS1 and IS2 between the melt portion 455 and the electrode tip 450 (see FIG. 1). Thus, the temperatures of the interfaces IS3 and IS4 between the melt portion 455 and the electrode base material 410 does not become high as compared to the temperatures of the interfaces IS1 and IS2 between the melt portion 455 and the electrode tip 450. That is, amounts of variation in the dimensions of the interfaces IS3 and IS4 at high temperature and at low temperature are small as compared to the interfaces IS1 and IS2 between the melt portion 455 and the electrode tip 450. Thus, even when the proportion of the material of the electrode tip 450 in the material of the melt portion 455 is increased to such a degree that the above mode exerts an advantageous effect, a possibility that a crack occurs at the interfaces IS3 and IS4 between the melt portion 455 and the electrode base material 410 is relatively low.

The above formulas (1) and (2) are preferably satisfied in any cross section passing through the axis CA. However, normally, a tip of a ground electrode in a spark plug is ideally provided so as to have rotational symmetry. Thus, it can be considered that if the above formulas (1) and (2) are satisfied in a predetermined cross section, the above advantageous effects of the present embodiment are obtained. Thus, whether the above formulas (1) and (2) are satisfied is determined in a plane RP which passes through the axis of the electrode tip 450 and includes the direction in which the ground electrode 400 extends (see the lower part of FIG. 2). Hereinafter, in determining the cross-sectional shape of the melt portion 455, the cross section RP is used as a reference. In the present embodiment, the cross section RP is a surface which does not include the portion WPL melted last by the applied laser beam in laser welding (see the lower part of FIG. 2).

Meanwhile, in the present embodiment, at the one side (the right side in FIG. 2) with respect to the axis CA, the point Pa1 farthest from the end surface 453, on the melt portion 455, is located at a position whose distance to the axis CA in a direction perpendicular to the axis CA is shorter than ⅔ of the length (W/2) from the axis CA to the outer surface 451 of the cylindrical portion 450*p*. In addition, at the other side (the left side in FIG. 2) with respect to the axis CA, the point Pa2 farthest from the end surface 453, on the melt portion 455, is located at a position whose distance to the axis CA in the direction perpendicular to the axis CA is shorter than ⅔ of the length (W/2) from the axis CA to the outer surface 451 of the cylindrical portion 450*p*. That is, the melt portion 455 has a shape which satisfies the following condition, in the cross section passing through the axis CA:

$$E1 < W/3 \quad (3), \text{ and}$$

$$E2 < W/3 \quad (4).$$

In such a mode, the melt portion 455 and the electrode tip 450 are in contact with each other at wider interfaces IS1 and IS2 as compared to a mode where the above formulas (3) and (4) are not satisfied. In addition, the melt portion 455 and the electrode base material 410 are also in contact with each other at wider interfaces IS3 and IS4 as compared to the mode where the above formulas (3) and (4) are not satisfied. Thus, the electrode tip 450 is firmly joined to the electrode base material 410 via the melt portion 455.

The melt portion 455 of the present embodiment also satisfies the following condition.

$$A1+A2 > B1+B2$$

The satisfaction of the above formula means that an amount (A1+A2) by which the melt portion 455 extends inward (toward the axis CA side) from the outer surfaces 451 and 452 is larger than an amount (B1+B2) by which the melt portion 455 extends outward from the outer surfaces 451 and 452. In such a mode, an amount of the melt portion 455 flowing outward of the outer surfaces 451 and 452 of the melt portion 455 is small, and a more amount of the electrode tip 450 melts at the inner side of the outer surfaces 451 and 452 of the melt portion 455, to form an interface with the melt portion 455. As a result, the end portion 454 of the melt portion 455 at the electrode base material 410 side can be firmly joined to the melt portion 455 in a wider area.

A3. Another Structure Around Electrode Tip of Ground Electrode

Figure 3:
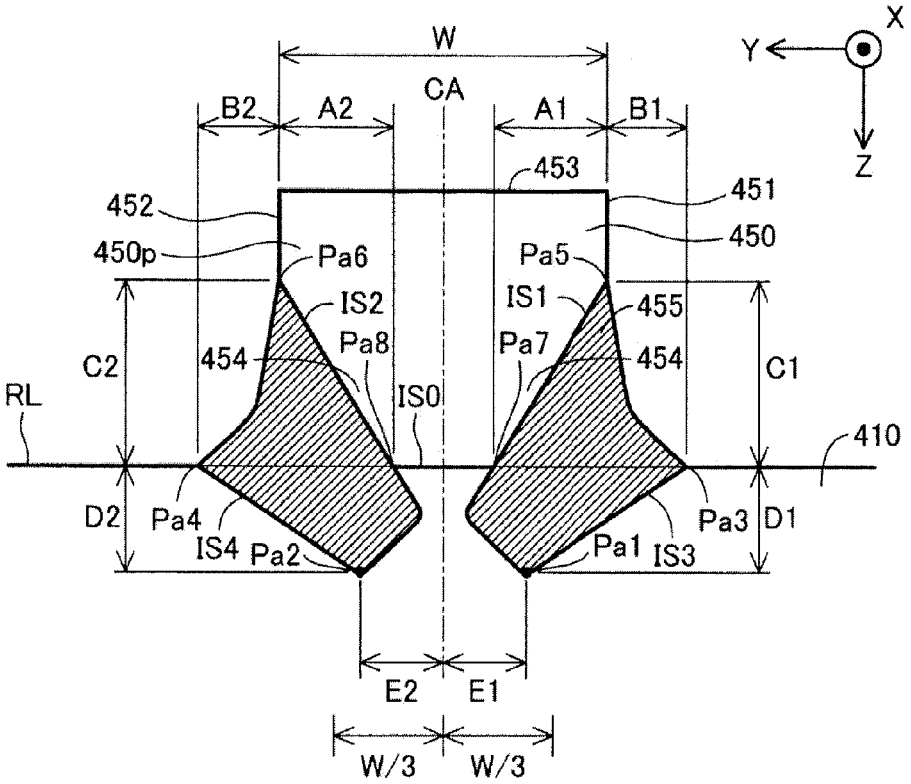
FIG. 3 is a cross-sectional view showing another structure around the electrode tip 450 provided at the ground electrode 400 of the spark plug 10.

FIG. 3 is a cross-sectional view showing another structure around the electrode tip 450 provided at the ground electrode 400 of the spark plug 10. In the mode of FIG. 2, the shape of the melt portion 455 is asymmetrical about the axis CA in the cross section RP. On the other hand, in the mode shown in FIG. 3, the shape of the melt portion 455 is substantially symmetrical about the axis CA in the cross section RP. Regarding the other points, the shape of the melt portion 455 in FIG. 3 is the same as the shape of the melt portion 455 in FIG. 2. In the present specification, the phrase "substantially symmetrical about a line" means that when one of two figures is inverted about the line, a portion having an area which is 90% or more of the area of the figure overlaps the other figure.

The melt portion 455 in the mode of FIG. 3 can be formed by a method in which, for example, as compared to the formation of the melt portion 455 in the mode of FIG. 2, the quality in each direction from the axis CA of the electrode tip 450 and the electrode base material 410 is made more uniform, or output of the laser beam in laser welding is stabilized. Also in the mode of FIG. 3, the conditions of the above formulas (1) to (4) can be satisfied.

As described above, in laser welding, the application of the laser beam is performed from around the electrode tip 450 toward the electrode tip 450 and the electrode base material 410 at 10 to 20 locations which are located at substantially equal angular positions with respect to the axis CA. Then, the three-dimensional shape of the formed melt portion 455 is desirably rotationally symmetrical about the axis CA (see FIG. 3). In such a mode, stress is unlikely to be concentrated on a portion of the melt portion 455. As a result, a crack is unlikely to occur. Thus, the possibility can be further reduced that a crack occurs and grows at the interfaces IS1 and IS2 between the melt portion 455 and the electrode tip 450.

The melting point of the material (e.g., platinum (Pt), iridium (Ir), ruthenium (Ru), rhodium (Rh), etc.) of the electrode tip 450 is higher than the melting point of the nickel alloy which is the material of the electrode base material 410. Thus, when the temperature of a predetermined range near the interface ISO between the electrode tip 450 and the electrode base material 410 becomes a temperature between the melting point of the electrode tip 450 and the melting point of the electrode base material 410 by the application of the laser beam, the electrode base material 410 at this site melts, but the electrode tip 450 does not melt. As a result, as in the vicinity of the point Pa1 in FIG. 2, the melt portion 455 is in contact with the end surface of the electrode tip 450 that has not been melted.

Figure 4:
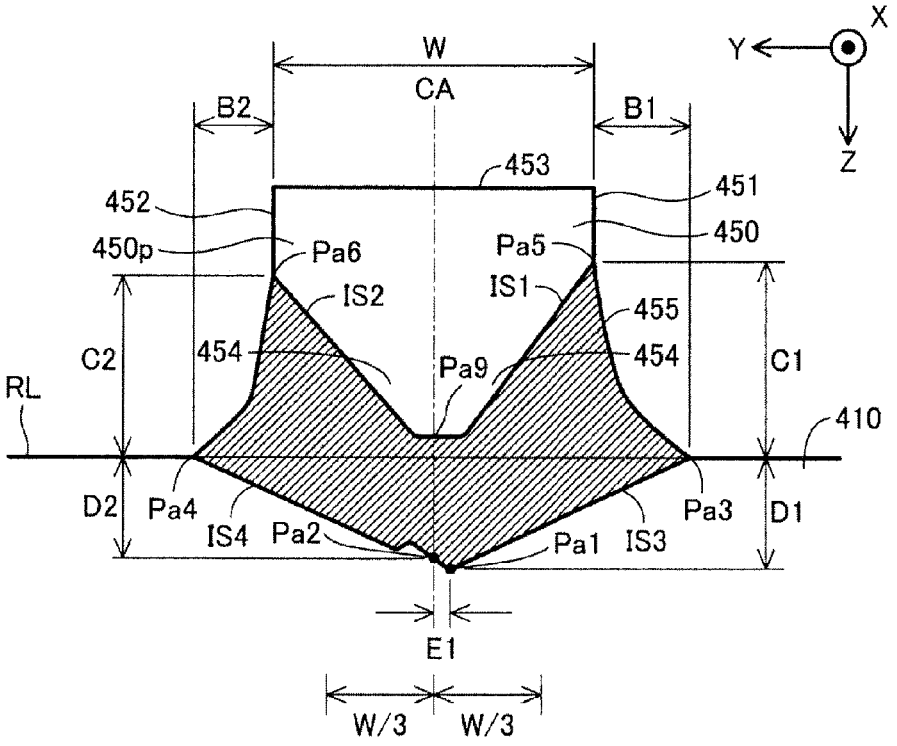
FIG. 4 is a cross-sectional view showing still another structure around the electrode tip 450 provided at the ground electrode 400 of the spark plug 10.

FIG. 4 is a cross-sectional view showing still another structure around the electrode tip 450 provided at the ground electrode 400 of the spark plug 10. In the mode of FIG. 2, in the cross section RP, the melt portion 455 is not present near the axis CA, but the interface ISO at which the electrode tip 450 and the electrode base material 410 are in contact with each other is present. On the other hand, in the mode shown in FIG. 4, the melt portion 455 extends from the outer surface 451 of the electrode tip 450 at the one side with respect to the axis CA through an area around the axis CA to the outer surface 452 of the electrode tip 450 at the other side with respect to the axis CA. The point Pa2 farthest from the end surface 453, on the melt portion 455 at the other side with respect to the axis CA, is located on the axis CA. Regarding the other points, the shape of the melt portion 455 in FIG. 4 is the same as the shape of the melt portion 455 in FIG. 2.

The melt portion 455 in the mode of FIG. 4 can be formed by a method in which, for example, as compared to the formation of the melt portion 455 in the mode of FIG. 2, the output of the laser beam is increased, or positions to which the laser beam is to be applied are made closer to the end surface 453 of the electrode tip 450. Also in the mode of FIG. 4, the conditions of the above formulas (1) to (4) can be satisfied.

The thermal expansion coefficient of the material (e.g., platinum (Pt), iridium (Ir), ruthenium (Ru), rhodium (Rh), etc.) of the electrode tip 450 is lower by 20 to 30% than the thermal expansion coefficient of the nickel alloy which is the material of the electrode base material 410. Thus, in a mode where the interface ISO between the electrode tip 450 and the electrode base material 410 is present (see FIGS. 2 and 3), due to temperature change in the thermal cycle of the engine, greater strain occurs at the interface ISO as compared to the other interfaces IS1 to IS4. The strain becomes maximum at the end of the interface ISO (see the points Pa1 and Pa8 in FIGS. 2 and 3), and there is a possibility that a crack occurs therefrom. In addition, there is a possibility that the crack grows not only at the interface ISO but also to the interfaces IS1 and IS2 between the melt portion 455 and the electrode tip 450, leading to falling-off of the electrode tip 450 from the electrode base material 410.

On the other hand, in the mode shown in FIG. 4, the entirety of the end portion 454 of the electrode tip 450 at the electrode base material 410 side is joined to the electrode base material 410 via the melt portion 455. The melt portion 455 is present between the electrode tip 450 and the electrode base material 410, and the interface ISO between the electrode tip 450 and the electrode base material 410 (see FIGS. 2 and 3) is not present. Thus, a possibility can be reduced that a crack grows from inside of the ground electrode 400 (the interface ISO) to the interfaces IS1 and IS2 between the melt portion 455 and the electrode tip 450.

Figure 5:
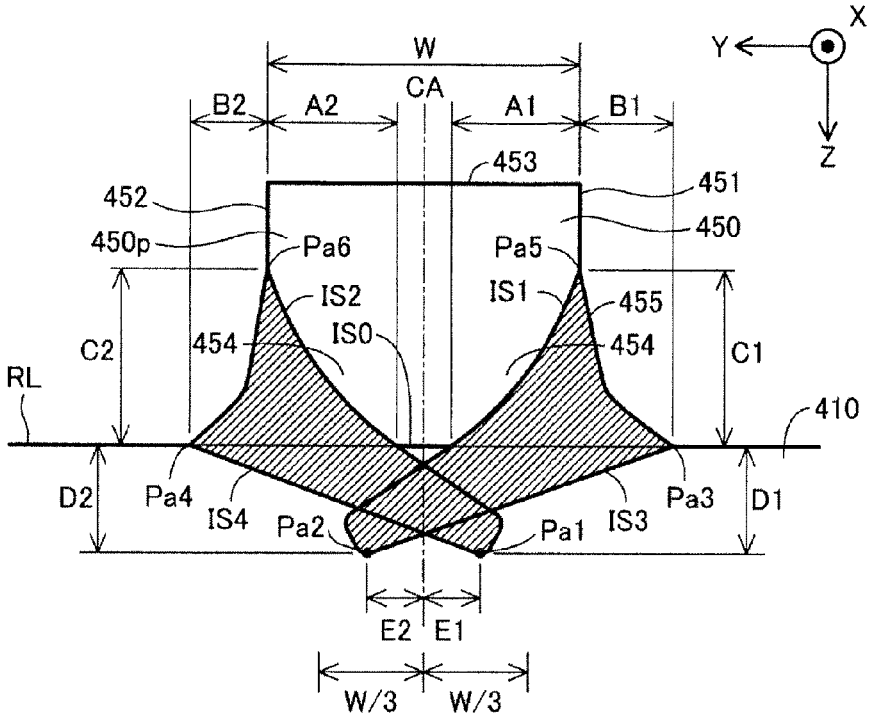
FIG. 5 is a cross-sectional view showing still another structure around the electrode tip 450 provided at the ground electrode 400 of the spark plug 10.

FIG. 5 is a cross-sectional view showing still another structure around the electrode tip 450 provided at the ground electrode 400 of the spark plug 10. In the mode of FIG. 2, in the cross section RP, the melt portion 455 formed by the laser beam applied to the outer surface 451 of the electrode tip 450 does not reach the axis CA. In addition, the melt portion 455 formed by the laser beam applied to the outer surface 452 of the electrode tip 450 also does not reach the axis CA. On the other hand, in the mode of FIG. 5, the melt portion 455 formed by the laser beam applied to the outer surface 451 of the electrode tip 450 reaches the opposite side across the axis CA. The melt portion 455 formed by the laser beam applied to the outer surface 452 of the electrode tip 450 also reaches the opposite side across the axis CA. As a result, the interfaces IS3 and IS4 between the melt portion 455 and the electrode base material 410 each have a complicated curved surface as compared to the mode of FIG. 2. Regarding the other points, the shape of the melt portion 455 in FIG. 5 is the same as the shape of the melt portion 455 in FIG. 2.

The melt portion 455 in the mode of FIG. 5 can be formed by a method in which, for example, as compared to the formation of the melt portion 455 in the mode of FIG. 2, the diameter of the laser beam is decreased, or the output of the laser beam is increased. Also in the mode of FIG. 5, the conditions of the above formulas (1) to (4) can be satisfied.

In the mode of FIG. 5, boundaries representing the interfaces IS3 and IS4 between the melt portion 455 and the electrode base material 410 each draw a complicated curved line which sharply bends. Thus, even when a crack occurs at the interfaces IS3 and IS4 between the melt portion 455 and the electrode base material 410, the crack is unlikely to grow along the interfaces IS3 and IS4.

In addition, the melt portion 455 and the electrode base material 410 are disposed in a manner where the melt portion 455 and the electrode base material 410 mesh with each other. In other words, the melt portion 455 and the electrode base material 410 are disposed in a manner where a projection of the electrode base material 410 is fitted into a recess of the melt portion 455 and a projection of the melt portion 455 is fitted into a recess of the electrode base material 410. Thus, even when a crack occurs at the interfaces IS3 and IS4 between the melt portion 455 and the electrode base material 410, the melt portion 455 is unlikely to fall off from the electrode base material 410.

Figure 6:
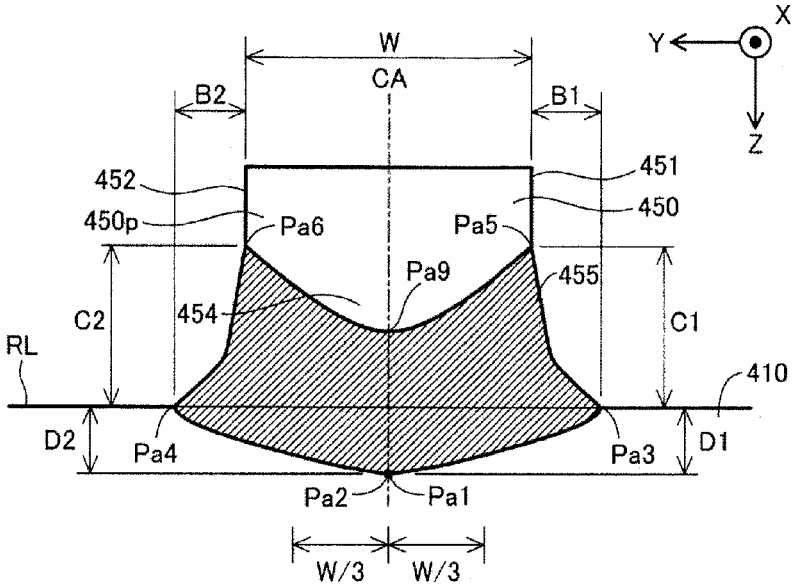
FIG. 6 is a cross-sectional view showing still another structure around the electrode tip 450 provided at the ground electrode 400 of the spark plug 10.

FIG. 6 is a cross-sectional view showing still another structure around the electrode tip 450 provided at the ground electrode 400 of the spark plug 10. In the mode of FIG. 4, in the cross section RP, the shape of the melt portion 455 is asymmetrical about the axis CA. On the other hand, in the mode shown in FIG. 6, in the cross section RP, the shape of the melt portion 455 is substantially symmetrical about the axis CA. The points Pa1 and Pa2 farthest from the end surface 453, on the melt portion 455, are the same. In addition, in the mode shown in FIG. 6, the point Pa9 farthest from the end surface 453 of the electrode tip 450, on the interfaces IS1 and IS2 between the melt portion 455 and the electrode tip 450, is located at a position closer to the end surface 453 of the electrode tip 450 than in the mode of FIG. 4 (at a higher position in FIGS. 4 and 6). Regarding the other points, the shape of the melt portion 455 in FIG. 6 is the same as the shape of the melt portion 455 in FIG. 4.

The melt portion 455 in the mode of FIG. 6 can be formed by a method in which, for example, as compared to the formation of the melt portion 455 in the mode of FIG. 4, the diameter of the laser beam is increased, or the positions to which the laser beam is to be applied are made closer to the end surface 453 of the electrode tip 450 in the axial direction. Also in the mode of FIG. 6, the conditions of the above formulas (1) to (4) can be satisfied.

As described above, the three-dimensional shape of the formed melt portion 455 is desirably rotationally symmetrical about the axis CA (see FIG. 6). In such a mode, a portion of the melt portion 455 is unlikely to be provided with a site where a crack is likely to occur. Thus, the possibility can be further reduced that a crack occurs and grows at the interfaces IS1 and IS2 between the melt portion 455 and the electrode tip 450.

In addition, over the entirety of the end portion 454 of the electrode tip 450, the melt portion 455 is present between the electrode tip 450 and the electrode base material 410 with a large thickness in the axial direction. Thus, the difference between the thermal expansion coefficient of the electrode tip 450 and the thermal expansion coefficient of the electrode base material 410 is likely to be absorbed by the melt portion 455. Therefore, the possibility can be further reduced that a crack occurs and grows at the interfaces IS1 and IS2 between the melt portion 455 and the electrode tip 450 and at the interfaces IS3 and IS4 between the melt portion 455 and the electrode base material 410.

The electrode tip 450 in the present embodiment corresponds to the "tip" in "Means for Solving the Problems". The axis CA corresponds to the "central axis". The cross section RP corresponds to the "cross section passing through the central axis". The points Pa1 to Pa6 correspond to the "first point" to "sixth point", respectively.

A4. Examples

A test for evaluating the peeling resistance of the electrode tip 450 was carried out by using samples formed with the above-described respective dimensions being set at various values. Prior to the test, samples in which the interface ISO between the electrode tip 450 and the electrode base material 410 is present, that is, samples in which an unmelted portion of the bottom of the electrode tip 450 is present (see FIGS. 2, 3, and 5), and samples in which the interface ISO, that is, an unmelted portion, is not present (see FIGS. 4 and 6) were prepared. The ground electrode of each spark plug used in the test has the following configuration.

Material of the electrode base material: INCONEL 601

Width of the ground electrode: 2.5 mm

Material of the electrode tip: an alloy containing platinum (Pt) as a principal component and 20 mass % of rhodium (Rh).

The "width of the ground electrode" is a dimension of a surface to which the electrode tip is attached, in a direction in which the ground electrode extends and in a direction perpendicular to the axial direction (the X axis direction). The portion to which the electrode tip is attached has a sufficient dimension equal to or larger than the width, in the direction in which the ground electrode extends (the Y axis direction).

A spark plug which is a test sample was mounted to one cylinder of a four-cylinder engine having a displacement of 1.5 L, plugs which are the same were mounted to the other cylinders for all experiments, and the test was carried out. In the test, a process in which the engine was operated at full throttle (an engine speed: 5000 rpm) for 1 minute and then operation was stopped for 1 minute was repeated for 100 hours.

The evaluation was carried out by measuring the size of oxide scale at the interface between the electrode tip and the melt portion in the cross section RP which passes through the axis CA of the spark plug and includes the direction in which the ground electrode 400 extends toward the axis CA (see the lower part of FIG. 2). Specifically, the peeling resistance was evaluated based on a ratio Ra, relative to W, of the total value of the length of oxide scale in the direction perpendicular to the axis CA (in the Y axis direction in FIG. 2) when the oxide scale was projected in the axial direction. In the present embodiment, the cross section RP is a surface which does not include the portion WPL melted last by the applied laser beam in laser welding (see the lower part of FIG. 2).

FIG. 7 is a table showing the results of the peeling resistance test carried out under the conditions described above. In the table of FIG. 7, the unit of each dimension is "mm". In the table of FIG. 7, a double circle which indicates "excellent" is given to a sample in which the ratio Ra of the total value of the length of the oxide scale relative to W is equal to or lower than 50%. A circle which indicates "good" is given to a sample in which Ra is higher than 50% and equal to or lower than 90%. X which indicates "poor" is given to a sample in which Ra is higher than 90%. Although not shown in the table, the spark plugs of the samples 1 to 15 satisfy the condition of the above formulas (3) and (4).

In the table of FIG. 7, the samples 3 to 5, the samples 7 to 10, and the samples 12 to 15 have both C1/D1 of 1.0 or higher and C2/D2 of 1.0 or higher, and satisfy both of the above formulas (1) and (2). For these samples, the peeling resistance was "excellent" (double circle) or "good" (circle). Thus, it is recognized that the peeling resistance is favorable in each spark plug that satisfies both of the above formulas (1) and (2).

Furthermore, in the table of FIG. 7, the samples 3 to 5, the samples 8 to 10, and the samples 13 to 15 satisfy both of the following formulas (5) and (6). For these samples, the peeling resistance was "excellent" (double circle). Thus, it is recognized that the peeling resistance is further favorable in each spark plug that satisfies both of the following formulas (5) and (6).

$$C1/D1 \geq 1.2 \quad (5)$$

$$C2/D2 \geq 1.2 \quad (6)$$

In the spark plug including the melt portion 455 having a shape that satisfies the formulas (5) and (6), the proportion of the material of the electrode tip 450 in the material of the melt portion 455 can be further increased as compared to a mode where the above formulas (5) and (6) are not satisfied. As a result, the thermal expansion coefficient (linear expansion coefficient) of the melt portion 455 can be close to the thermal expansion coefficient of the electrode tip 450. Thus, the possibility can be further reduced that when the engine is operated so that a combustion cycle is executed, a crack occurs and grows at the interface between the melt portion 455 and the electrode tip 450. In addition, as a result, the possibility can be further reduced that oxide scale grows at the crack portion.

In addition, in the table of FIG. 7, the samples 3 to 5, the samples 9 and 10, and the sample 15 are samples that satisfy both of the above formulas (1) and (2) and further have no unmelted portion of the tip bottom (see FIGS. 4 and 6). For these samples, the peeling resistance was "excellent" (double circle). Thus, it is recognized that the peeling resistance is further favorable in each spark plug that satisfies both of the above formulas (1) and (2) and further has no unmelted portion of the tip bottom (see FIG. 4).

B. Modified Embodiments

B1. Modified Embodiment 1

In the embodiments described above, the electrode tip 450 has a cylindrical shape before being joined to the electrode base material 410, and the end portion 450*p* of the electrode tip 450 has a cylindrical shape after the electrode tip 450 is joined to the electrode base material 410. However, before being joined to the electrode base material, the electrode tip may have another shape such as a square column and a hexagonal column. After the electrode tip is joined to the electrode base material, the end portion of the electrode tip may have another shape such as a square column and a hexagonal column. However, each of the electrode tip and the end portion of the electrode tip preferably has a columnar shape, and further preferably has a shape having rotational symmetry about the axis.

In the present specification, the "columnar shape" means a three-dimensional shape in which a cross-sectional shape in any cross section perpendicular to a predetermined direction is uniform along the direction. In addition, the "central axis of the columnar shape" is an axis which: is parallel to a direction in which the columnar portion extends; and passes through the centroid of a cross section of the columnar portion on a plane perpendicular to the direction in which the columnar portion extends.

B2. Modified Embodiment 2

In the embodiment of FIG. 2, the shape of the melt portion 455 satisfies the condition of A1+A2>B1+B2. However, the shape of the melt portion 455 may satisfy A1+A2≤B1+B2.

B3. Modified Embodiment 3

In the embodiments shown in FIGS. 2 to 6, the points Pa3 and Pa4 farthest from the axis CA, on the melt portion 455, are located on the surface of the electrode base material 410. Thus, the reference line RL, which is a straight line passing through the point Pa3 and the point Pa4, coincides with a line representing the surface of the electrode base material 410. However, the point Pa3 and the point Pa4 do not necessarily need to be located on the surface of the electrode base material 410.

In addition, in the embodiments described above, the surface of the electrode base material 410 is a flat surface. Thus, in the embodiments described above in which the points Pa3 and Pa4 are located on the surface of the electrode base material 410, the surface of the electrode base material 410 on the cross section RP coincides with the reference line RL. However, the surface of the electrode base material 410 may not be a flat surface.

Also in a mode where the points Pa3 and Pa4 are not located on the surface of the electrode base material 410 or the surface of the electrode base material to which the electrode tip is joined is not a flat surface, as long as the above formulas (1) and (2) which are defined based on the reference line RL are satisfied, the thermal expansion coefficient (linear expansion coefficient) of the melt portion 455 can be close to the thermal expansion coefficient of the electrode tip 450 as compared to the mode where the above formulas (1) and (2) are not satisfied. Thus, occurrence and growth of a crack and oxide scale at the interface between the electrode tip and the melt portion can be suppressed.

B4. Modified Embodiment 4

In the embodiments shown in FIGS. 2, 3, and 5, the interface ISO between the electrode tip 450 and the electrode base material 410 is present. In the embodiments shown in FIGS. 4 and 6, there is no interface ISO, and the entirety of the end portion 454 of the electrode tip 450 is joined to the melt portion 455. However, the mode in which the electrode tip 450 is joined to the melt portion 455 may be another mode. For example, the end portion 454 of the electrode tip 450 may have an interface with a component other than the melt portion 455 and the electrode base material 410.

B5. Modified Embodiment 5

In the Examples described above, the test was carried out for the samples each having an electrode tip diameter W of 0.8 mm, 1.0 mm, or 1.5 mm. However, even when the electrode tip diameter W is another size, as long as the above formulas (1) and (2) are satisfied, the thermal expansion coefficient of the melt portion can be close to the thermal expansion coefficient of the electrode tip as compared to the mode where the above formulas (1) and (2) are not satisfied. Thus, occurrence and growth of a crack and oxide scale at the interface between the electrode tip and the melt portion can be suppressed.

B6. Modified Embodiment 6

In the embodiments described above, the cross section RP which is used as a reference when the cross-sectional shape of the melt portion is determined is a surface which does not include the portion WPL melted last by the applied laser beam, of the melt portion 455. However, the cross section which is used as a reference when the cross-sectional shape of the melt portion is determined may include the portion WPL melted last by the applied laser beam, of the melt portion 455.

The present invention is not limited to the embodiments, examples, and modified embodiments described above, and can be embodied in various configurations without departing from the gist of the present invention. For example, the technical features in the embodiments, examples, and modified embodiments corresponding to the technical features in each mode described in the Summary of the Invention section can be appropriately replaced or combined to solve some of or all of the foregoing problems, or to achieve some of or all of the foregoing effects. Further, such technical features may be appropriately deleted if not described as being essential in the present specification.

DESCRIPTION OF REFERENCE NUMERALS

10: spark plug
90: internal combustion engine
100: center electrode
190: metal terminal
200: insulator
290: axial bore
300: metallic shell
310: end surface
400: ground electrode
410: electrode base material
450: electrode tip
450*p*: end portion of electrode tip
451, 452: outer surface of electrode tip
453: end surface of electrode tip
455: melt portion
910: inner wall
920: combustion chamber
CA: axis
ISO: interface between electrode tip 450 and electrode base material 410
IS1, IS2: interface between melt portion 455 and electrode tip 450
IS3, IS4: interface between melt portion 455 and electrode base material 410
RL: reference line
SG: gap (spark gap)
Pa1: point farthest from end surface 453, on melt portion 455 at one side with respect to axis CA
Pa2: point farthest from end surface 453, on melt portion 455 at other side with respect to axis CA
Pa3: point farthest from axis CA, on melt portion 455 at one side with respect to axis CA
Pa4: point farthest from axis CA, on melt portion 455 at other side with respect to axis CA
Pa5: point closest to end surface 453, on melt portion 455 at one side with respect to axis CA
Pa6: point closest to end surface 453, on melt portion 455 at other side with respect to axis CA
Pa7: end point of interface ISO at one side with respect to axis CA
Pa8: end point of interface ISO at other side with respect to axis CA
Pa9: point farthest from end surface 453 of electrode tip 450, on interfaces IS1 and IS2
WPL: portion welded last in welding of electrode tip and electrode base material

The invention claimed is:

1. A spark plug comprising:
a ground electrode including;
a tip having a columnar portion at one end side and containing a noble metal as a principal component, and
an electrode base material, at least a portion of another end side of the tip being joined to the electrode base material via a melt portion formed by the tip and the electrode base material being melted together, wherein
in a cross section passing through a central axis of the columnar portion, both a first point and a second point are located at a position whose distance to the central axis in a direction perpendicular to the central axis is shorter than ⅔ of a length from the central axis to an outer surface of the columnar portion, where the first point is located on the melt portion at one side with respect to the central axis and is farthest from a surface of the tip at the one end side in a direction of the central axis; and the second point is located on the melt portion at another side with respect to the central axis and is farthest from the surface of the tip at the one end side in the direction of the central axis, and
in the cross section, when a line connecting a third point and a fourth point is defined as a reference line, the spark plug satisfies a relationship of: C1≥D1 and C2≥D2, where,
the third point is located on the melt portion at the one side with respect to the central axis and is farthest from the central axis,
the fourth point is located on the melt portion at the other side with respect to the central axis and is farthest from the central axis,
a distance between the reference line and a fifth point is defined as C1, where the fifth point is located on the melt portion at the one side with respect to the central axis and is closest to the surface of the tip at the one end side in the direction of the central axis,
a distance between the reference line and a sixth point is defined as C2, where the sixth point is located on the melt portion at the other side with respect to the central axis and is closest to the surface of the tip at the one end side in the direction of the central axis,
a distance between the first point and the reference line is defined as D1, and
a distance between the second point and the reference line is defined as D2.

2. A spark plug according to claim 1, wherein the spark plug satisfies a relationship of:
C1/D1≥1.2 and C2/D2≥1.2.

3. A spark plug according to claim 1, wherein the other end side of the tip is not in direct contact with the electrode base material and is joined to the electrode base material via the melt portion.

4. A spark plug according to claim 2, wherein the other end side of the tip is not in direct contact with the electrode base material and is joined to the electrode base material via the melt portion.

* * * * *